US009488194B2

(12) United States Patent
Bachmaier et al.

(10) Patent No.: US 9,488,194 B2
(45) Date of Patent: Nov. 8, 2016

(54) HYDRAULIC TEMPERATURE COMPENSATOR AND HYDRAULIC LIFT TRANSMITTER

(75) Inventors: Georg Bachmaier, München (DE); Gerit Ebelsberger, München (DE); Bernhard Fischer, Töging A. Inn (DE); Michael Höge, Kirchseeon (DE); Erhard Magori, Feldkirchen (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 652 days.

(21) Appl. No.: 13/822,831

(22) PCT Filed: Aug. 22, 2011

(86) PCT No.: PCT/EP2011/064362

§ 371 (c)(1),
(2), (4) Date: May 28, 2013

(87) PCT Pub. No.: WO2012/034823

PCT Pub. Date: Mar. 22, 2012

(65) Prior Publication Data

US 2013/0269790 A1 Oct. 17, 2013

(30) Foreign Application Priority Data

Sep. 13, 2010 (DE) ..... 10 2010 040 612

(51) Int. Cl.
*F15B 7/10* (2006.01)
*F02M 61/16* (2006.01)
*F02M 63/00* (2006.01)

(52) U.S. Cl.
CPC ..... *F15B 7/10* (2013.01); *F02M 61/167* (2013.01); *F02M 63/0026* (2013.01);
(Continued)

(58) Field of Classification Search
CPC ..... F02M 2200/705; F02M 2200/708; F02M 61/167; F15B 15/08
USPC ..... 121/498
See application file for complete search history.

(56) References Cited

U.S. PATENT DOCUMENTS 4,858,439 A 8/1989 Sawada et al.
6,062,532 A 5/2000 Gürich et al.

(Continued)

FOREIGN PATENT DOCUMENTS

DE 29708546 9/1998
DE 19958704 6/2001

(Continued)

OTHER PUBLICATIONS

Khonsari, M. M., Booster, E. R. "Know Your Thrust Bearings: Operating conditions and design constraints dictate which type make sense". Machine Design. Apr. 12, 2007. [retrieved Jul. 7, 2015] <URL: http://machinedesign.com/bearings/know-your-thrust-bearings>.*

(Continued)

*Primary Examiner* — F. Daniel Lopez
*Assistant Examiner* — Richard Drake
(74) *Attorney, Agent, or Firm* — Slayden Grubert Beard PLLC

(57) ABSTRACT

The hydraulic temperature compensator has at least one longitudinally extensible hydraulic chamber and a gas-filled chamber which is at least partly enclosed by the hydraulic chamber, wherein the hydraulic chamber is subdivided into a first sub-chamber and a second sub-chamber which are hydraulically connected to each other by at least one throttle point and wherein the second sub-chamber adjoins the gas-filled chamber. The stroke transmitter has at least the hydraulic temperature compensator, a stroke actuator acting on the temperature compensator, and a further hydraulic chamber which is fluidically connected to the first sub-chamber of the hydraulic chamber of the temperature compensator, wherein the further hydraulic chamber is in fluidic connection with a displaceably mounted actuating element.

14 Claims, 2 Drawing Sheets

(52) U.S. Cl.
CPC ..... *F02M 63/0057* (2013.01); *F02M 2200/21* (2013.01); *F02M 2200/703* (2013.01); *F02M 2200/705* (2013.01); *F02M 2200/708* (2013.01); *Y10T 137/2516* (2015.04)

(56) References Cited

U.S. PATENT DOCUMENTS

| | | | | |
|---|---|---|---|---|
| 7,665,484 | B2 * | 2/2010 | Kamada | F02M 37/0041 138/30 |
| 8,267,675 | B2 * | 9/2012 | Bai et al. | 417/413.2 |
| 2005/0236499 | A1 | 10/2005 | Okada | |
| 2005/0247803 | A1 * | 11/2005 | Liskow | 239/102.2 |

FOREIGN PATENT DOCUMENTS

| | | | | |
|---|---|---|---|---|
| DE | 19958704 | A1 * | 6/2001 | F15B 15/08 |
| DE | 10321693 | | 12/2004 | |
| DE | 102004060533 | | 6/2006 | |
| DE | 102005042786 | | 3/2007 | |
| DE | 102010040612.0 | | 9/2010 | |
| EP | 1 111 230 | A2 | 6/2001 | |
| EP | 1591656 | | 11/2005 | |
| EP | 1970556 | A1 * | 9/2008 | F02M 51/06 |
| WO | PCT/EP2011/064362 | | 8/2011 | |

OTHER PUBLICATIONS

German Office Action for corresponding German Patent Application No. 10 2010 040 612.0, issued Dec. 11, 2013, 5 pages.
International Search Report for PCT/EP2011/064362, mailed on Nov. 7, 2011.
Office Action dated Dec. 11, 2013 in corresponding German Patent Application No. 102010040612.0.
Extended European Search Report dated Oct. 16, 2015 in corresponding European Patent Application No. 15001834.9.

* cited by examiner

HYDRAULIC TEMPERATURE COMPENSATOR AND HYDRAULIC LIFT TRANSMITTER

CROSS REFERENCE TO RELATED APPLICATIONS

This application is based on and hereby claims priority to International Application No. PCT/EP2011/064362 filed on Aug. 22, 2011 and German Application No. 10 2010 040 612.0 filed on Sep. 13, 2010, the contents of which are hereby incorporated by reference.

BACKGROUND

The invention relates to a hydraulic temperature compensator. The invention further relates to a hydraulic stroke transmitter having such a hydraulic temperature compensator, in particular an injector.

In order to introduce a desired volume of fuel into arbitrary combustion processes it is generally necessary to use injectors by which it is possible to meter a fuel quantity. Since very many combustion processes execute by the direct injection of fuel that is maintained under high pressure, particularly fast operating actuators are frequently used which drive injectors. This means that an actuator generates a stroke which for example actuates an injector needle which in turn opens a valve and releases a fuel at predetermined time intervals and in adjustable volumetric flow rates for a combustion process. Combustion air is supplied separately in this case.

Injectors for high-pressure direct injection frequently employ high-speed actuators for this purpose, such as "piezoelectric multilayer actuators" (PMA) for example. These are solid-state actuators, the central element of which is composed of a plurality of piezoelectric layers. Also known are so-called magnetostrictive solid-state actuators, which exploit a magnetic-mechanical effect in order to generate a stroke. For generating a stroke it is important that solid-state actuators of the type have a stroke that is too small for opening an injector needle to such an extent that the desired fuel quantity is introduced. This develops into a major problem, particularly in the case of gas injectors, which require a longer stroke than injectors that meter liquid fuel. The consequence is that only designs including a stroke transmitter are given consideration.

An additional aggravating factor when hydrogen is used as the fuel is that the small and lightweight hydrogen molecule easily diffuses through nonmetallic elements such as rubber diaphragms. The choice of a suitable stroke transmitter therefore becomes a central problem in the building of injectors. This also results from the fact that a transmitter determines many characteristics of an injector and in contrast to an actuator can be redesigned in terms of its structure.

In related art solutions to the problem an increase in stroke is achieved by mechanical transmission or by partially nonmetallically sealed hydraulic transmission. Mechanical transmitters, which for example use a mechanical lever, are generally susceptible to wear and tear and to undesirable vibrations. This applies in particular when an idle stroke is required between actuator and transmitter, for example in order to prevent a leakage which could occur in the event of a thermal change in length due to heating. As a result thereof the actuator will for example strike a nozzle needle, thereby unfavorably affecting the injector. Uneven injection and unreliable opening and closing characteristics are the consequence. An idle stroke between actuator and transmitter is also undesirable because the actuator deflection up to the point of contact with the nozzle needle remains unused.

An increase in the stroke of an actuator having a transmission ratio of less than 1:2 is often realized by mechanical levers. With injectors for diesel engines, for example, the mechanical transmission ratio can amount to 1:1.6. Gas injectors typically require greater transmission ratios. Hydraulic transmitters, also referred to as hydraulic levers, are used in gas injectors in most cases. A stroke transmission ratio of 1:6 is used for example in the case of direct injection of CNG (compressed natural gas).

Using a hydraulic transmitter enables the idle stroke to be avoided, with the result that the functional chain between actuator and nozzle needle is permanently present. This is reflected directly in the mechanical engineering design. Considered from a different angle, the deflection of the actuator is utilized and converted to a greater extent by the injector.

A disadvantage in the related art, in the automotive engineering sector for example, is the wide temperature range to be considered, which can range from −40 C.° to +150 C.°. In the consideration of fluid volumes, this can be associated with significant changes in volume. Peak values can lie significantly in excess of a 30% increase in volume. For this reason hydraulic stroke transmitters require a connection to a reservoir in most cases.

The unexamined German patent application publication DE 10 2005 042 786 A1 discloses for example a fuel injector which is equipped with a hermetically sealed hydraulic system. In this publication the use of so-called "guided pistons" is described. Guided pistons of this kind necessitate a high degree of mechanical precision in manufacture and are very susceptible to wear and tear.

SUMMARY

One potential object is to overcome at least some of the disadvantages of the related art and in particular to provide for a particularly low-wear temperature compensation of a self-contained hydraulic system.

The inventors propose a hydraulic temperature compensator at least comprising a longitudinally extensible hydraulic chamber and a gas-filled chamber which is at least partly enclosed by the hydraulic chamber, wherein the hydraulic chamber is subdivided into a first sub-chamber and a second sub-chamber which are hydraulically connected to each other by at least one throttle point and the second sub-chamber adjoins the gas-filled chamber.

If a temperature at the temperature compensator increases (typically slowly), there is also a slow increase in the pressure of a fluid contained in the hydraulic chamber due to the thermal expansion of the fluid. With regard to the slow rise in pressure, the first sub-chamber and the second sub-chamber are fluidically connected practically unobstructed by the throttle point. Owing to the pressure increase in the fluid and the greater pressure difference resulting therefrom between the second sub-chamber and the gas-filled chamber, the (inner) gas-filled chamber is compressed, thereby enabling the fluid to expand and limiting the pressure increase in the fluid, in particular to a practically negligible degree. This process is frictionless and consequently free of wear and tear. The pressure limiting can also be used in particular for hydraulic elements or devices that are fluidically connected to the hydraulic chamber, in particular to the first sub-chamber thereof.

For high-speed processes in which the throttle point is permeable only to a small degree to the fluid during an actuation interval, a pressure can be transferred substantially losslessly in particular by way of the first sub-chamber or, e.g. as a result of compression of the temperature compensator, can be built up substantially losslessly and passed on if necessary. The temperature compensator is therefore suitable in particular for use in or with fast-switching stroke transmitters (hydraulic levers) and final control elements.

The temperature compensator can be operated effectively frictionlessly and consequently free of wear and tear and enables both an effective temperature compensation and a largely lossless transfer and/or buildup of pressure. Furthermore, the temperature compensator has a particularly compact design format.

The throttle point can be embodied for example as a fluid conduit (e.g. in the form of a drilled hole) having a suitably dimensioned flow cross-section.

It is an embodiment that the gas-filled chamber is an open chamber. Toward that end the gas-filled chamber can be connected to the environment of the temperature compensator in particular by way of a passage aperture. Alternatively the gas-filled chamber can be hermetically sealed. The gas can be in particular air, i.e. the gas-filled chamber can be an air chamber.

It is also an embodiment that

- the hydraulic chamber is formed by an inner wall contactlessly inserted into an outer wall,
- a partition is contactlessly inserted between the outer wall and the inner wall in order to form the first sub-chamber and the second sub-chamber and the partition includes the at least one throttle point,
- the inner wall, the outer wall and the partition are each open at one side and are hermetically attached by their respective open side to a common cover, and
- the gas-filled chamber is formed by an inside surface of the inner wall.

This embodiment can be constructed particularly easily and robustly. Furthermore, a deformation of the temperature compensator and a pressure buildup resulting therefrom in the event of a rapid deformation are easily achievable by way of a relative displacement of the cover.

The partition can be embodied in particular as rigid. The inner wall and the outer wall can be in particular longitudinally extensible (compressible/expandable).

The inner wall can also be described as integrated into the outer wall.

It is yet a further embodiment that the inner wall and/or the outer wall are in each case embodied in the form of a bellows open at an end side, in particular a metal bellows. The bellows has the advantage that it is far more easily extensible in a longitudinal direction (in particular compressible and re-expandable) than perpendicularly thereto and the deformability is easily achievable in terms of technical design. Furthermore, bellows can be manufactured at low cost and are easy to handle and mount.

It is furthermore an embodiment that the partition is embodied in the form of a (rigid) hollow cylinder open at an end side (and having an arbitrary, advantageously circular, cross-section). This has the advantage that a volume in the first sub-chamber is essentially dependent only on a deformation of the outer metal bellows and a volume in the second sub-chamber is essentially dependent only on a deformation of the inner metal bellows, and the two volumes are in operative connection with each other only by the throttle point.

It is a development that the bellows and the partition are arranged concentrically with respect to a common axis.

It is also an embodiment that the outer wall is hermetically attached to the partition and the partition is hermetically attached to the cover. The outer wall is therefore indirectly attached to the cover. Alternatively the outer wall and the partition can be hermetically attached individually (directly) to the cover.

It is furthermore an embodiment that at least one compression spring element is accommodated in the gas-filled chamber. This yields the advantage that a (static) system pressure can be set in the hydraulic fluid. In this way it is also possible to set a relationship between a pressure difference between the second sub-chamber and the gas-filled chamber on the one hand and a change in volume of the second sub-chamber with particular precision.

Since the gas-filled chamber can be embodied as open to the outside, the spring force of the spring element can also be adjusted individually and subsequently by an actuating element projecting into the gas-filled chamber, e.g. an adjusting screw. This enables the system pressure to be varied subsequently.

It is also an embodiment that the hydraulic chamber has a unidirectional valve, in particular a flutter valve, which allows a flow from the second sub-chamber into the first sub-chamber. This enables a dead time between two compression phases of the temperature compensator to be shortened.

It is furthermore an embodiment that the hydraulic chamber is filled with a substantially incompressible fluid, in particular with oil, in particular hydraulic oil, in particular free of bubbles. This can be achieved by vacuum filling. Stroke and/or pressure losses can be prevented in this way.

The inventors also propose a hydraulic stroke transmitter at least comprising the hydraulic temperature compensator as described above, a stroke actuator acting on the temperature compensator, and a further hydraulic chamber which is fluidically connected to the first sub-chamber of the hydraulic chamber of the temperature compensator, the further hydraulic chamber being in fluidic connection with a displaceably mounted actuating element. Thermally induced pressure fluctuations in a hydraulic fluid can be limited at least to a large extent in the stroke transmitter by the hydraulic temperature compensator and a switching precision increased as a result. Furthermore, a pressure buildup or a pressure transfer can be realized substantially losslessly by the hydraulic stroke transmitter.

The hydraulic stroke transmitter can also be embodied as a hydraulic lever. The hydraulic stroke transmitter can furthermore be embodied as a valve, in particular an injection valve.

For the situation in which in the case of the hydraulic temperature compensator the hydraulic chamber is formed by an inner wall contactlessly inserted into an outer wall, a partition is contactlessly inserted between the outer wall and the inner wall in order to form the first sub-chamber and the second sub-chamber and the partition includes the at least one throttle point, the inner wall, the outer wall and the partition are in each case open at one side and are hermetically attached to a common cover by their respective open side and the gas-filled chamber is formed by an inside surface of the inner wall, the stroke actuator can be connected in particular to the cover. A largely lossless application of the stroke onto the hydraulic temperature compensator is made possible in this way.

It is also an embodiment that the stroke actuator and the temperature compensator are mounted between two thrust bearings. This enables the hydraulic temperature compensator to be used in a particularly simple manner for building up a pressure.

It is also an embodiment that the stroke transmitter constitutes a part of an injector. This improves a temperature-independent injection, in particular of fuel into a combustion chamber of an engine. The injector can be e.g. a fluid injector (for example a diesel, kerosene, liquefied petroleum gas or gasoline injector) or a gas injector (for example a hydrogen injector or natural gas injector).

The hydraulic stroke transmitter can be provided in particular for transmitting the primary stroke of the stroke actuator to an actuating element.

The hydraulic stroke transmitter can be a hydraulic stroke transmitter. Alternatively the hydraulic stroke transmitter can be a hydraulic stroke reducer.

The stroke actuator, the inner wall, the outer wall and the partition can be arranged concentrically with respect to one another.

BRIEF DESCRIPTION OF THE DRAWINGS

These and other objects and advantages of the present invention will become more apparent and more readily appreciated from the following description of the preferred embodiments, taken in conjunction with the accompanying drawings of which.

DETAILED DESCRIPTION OF THE PREFERRED EMBODIMENT

Figure 1:
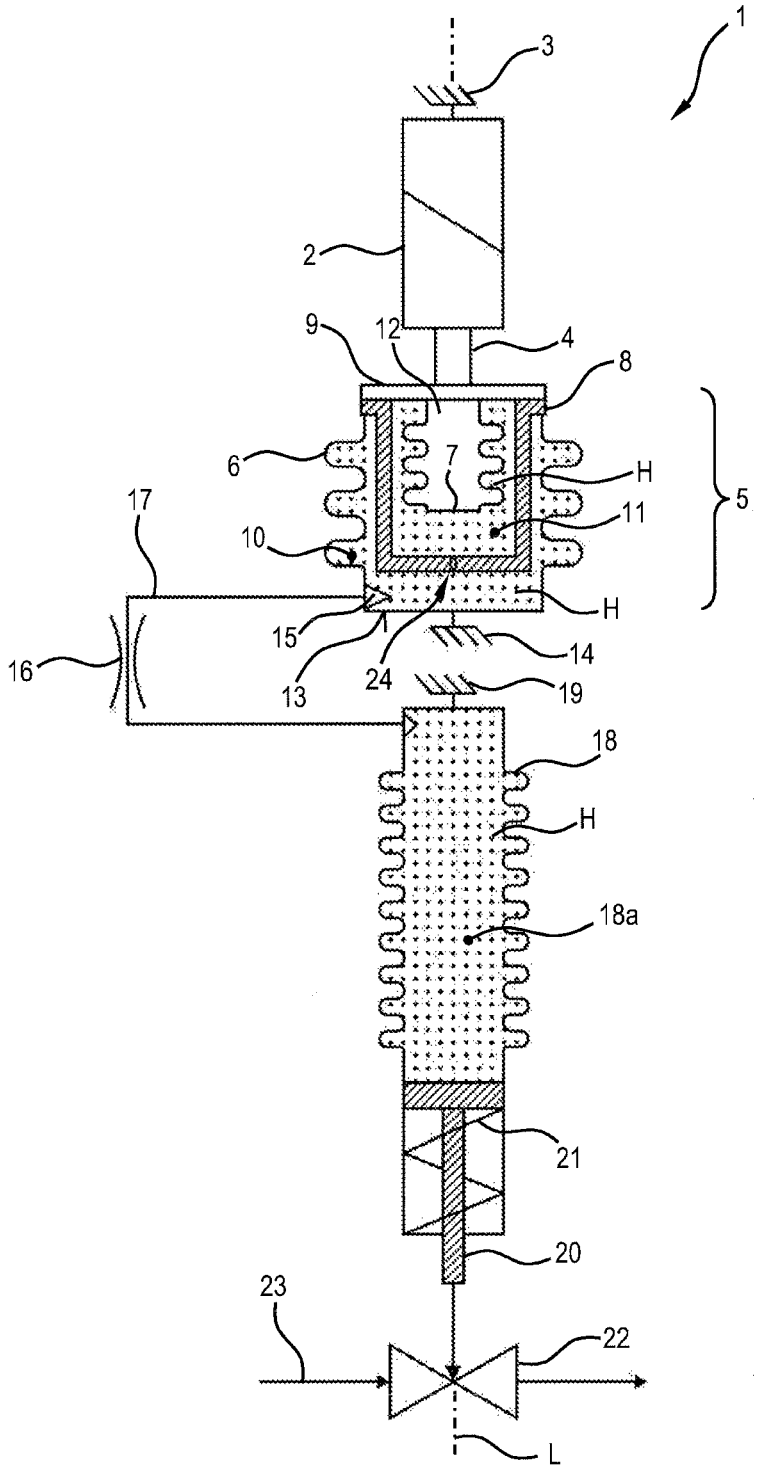
FIG. 1 shows as a sectional representation in a side view a hydraulically driven valve having a proposed thermal compensator according to a first embodiment variant.

Reference will now be made in detail to the preferred embodiments of the present invention, examples of which are illustrated in the accompanying drawings, wherein like reference numerals refer to like elements throughout.

FIG. 1 schematically illustrates a hydraulically driven valve 1, for example an injector, in particular a fuel injector. The valve 1 has a solid-state stroke actuator in the form of a piezoelectric actuator 2 which bears with its rear face against a thrust bearing 3 and on its front face has a lifter 4. The lifter 4 is displaceable along a body axis or longitudinal axis L. The lifter 4 is linked to a thermal compensator 5 according to a first embodiment variant.

The thermal compensator 5 has an outer wall in the form of an outer metal bellows 6 open at one side. Inserted in the outer metal bellows 6 is an inner metal bellows 7 which is smaller in length and diameter and is likewise open at an end side. Located between the outer metal bellows 6 and the inner metal bellows 7 is a partition 8 in the form of a rigid hollow cylinder which is open at an end side. The outer metal bellows 6, the inner metal bellows 7 and the partition 8 are embodied substantially rotationally symmetrically about a respective longitudinal axis L and are arranged concentrically with respect to the body axis of the piezoelectric actuator 2. Included in the partition 8 is a throttle point 24 which connects the first sub-chamber 10 to the second sub-chamber 11.

The outer metal bellows 6, the inner metal bellows 7 and the partition 8 are spaced apart from one another contactlessly at least at the side (relative to the body axis of the piezoelectric actuator 2 or the longitudinal axis L).

The outer metal bellows 6, the inner metal bellows 7 and the partition 8 are aligned such that their open end surfaces or end sides point in the direction of a cover 9 or an end plate. The outer metal bellows 6, the inner metal bellows 7 and the partition 8 are attached by their open sides in particular directly or indirectly to the cover 9. To put it more accurately, the inner metal bellows 7 is in this case hermetically and fixedly attached to the cover 9, e.g. by a welded joint, by its open side or by its free edge. The outer metal bellows 6 is hermetically attached to a laterally projecting edge region of the free edge of the partition 8, for example by a welded joint. The outer metal bellows 6 and the partition 8 thus form a first sub-chamber 10.

The partition 8 is likewise attached to the cover 9 by its free edge, e.g. by a welded joint, and moreover laterally outside in relation to the inner metal bellows 7. The inner metal bellows 7, the partition 8 and the cover 9 form a second sub-chamber 11. The gas-filled chamber 12 formed by an internal volume of the second metal bellows 7 is therefore separated from the second sub-chamber 11 solely by the second metal bellows 7. The gas-filled chamber 12 does not need to be hermetically sealed off from an environment of the valve 1 and can for example be pneumatically open to the environment by way of one or more passage apertures (not shown).

The lifter 4 is accordingly linked to an outside face of the cover 9, and a base region 13 of the outer metal bellows 6 disposed opposite the cover 9 is connected to a further thrust bearing 14. The thermal compensator 5 and the piezoelectric actuator 2 are consequently connected mechanically in series and inserted between the two thrust bearings 3, 14.

On its outer metal bellows 6 the thermal compensator 5 has a hydraulic connecting port 15 to which a hydraulic line 17, provided in this case with a throttle 16, is connected. The hydraulic line 17 leads to a further metal bellows 18 which encloses a further hydraulic chamber **18*a* filled with the hydraulic fluid H. The metal bellows 18 is rearwardly connected to a further thrust bearing 19 or bears thereon. An open end of the metal bellows 18 is closed by an actuating element in the form of a secondary lifter 20. The secondary lifter 20 is mounted so as to be linearly displaceable and is pressed by a spring element 21 into the further metal bellows 18. The secondary lifter 20 is provided as an actuating element for opening or closing a valve element 22 which can optionally open or close a fluid line 23, e.g. a fuel supply line to a combustion chamber of an engine. The secondary lifter 20 can be integrated into the valve 22 or constitute a part of the valve 22**.

The first sub-chamber 10, the second sub-chamber 11, the hydraulic line 17 and the further metal bellows 18 are filled with a substantially incompressible hydraulic fluid H. The hydraulic fluid H can be a hydraulic oil for example. The incompressibility can be reinforced for example by vacuum filling.

The valve 1 between the stroke actuator 2 and the secondary lifter 20 can also be described as a hydraulic lever.

During an operation of the valve 1 with a fast stroke movement of the piezoelectric actuator 2, the lifter 4 is extended or displaced comparatively rapidly in the direction of the cover 9. Since the piezoelectric actuator 2 is supported at the rear by the thrust bearing, the cover 9 is displaced in the direction of the bellows 6, 7 and the partition 8. Because the base 13 of the outer metal bellows 6 is supported on the thrust bearing 14, the outer metal bellows 6 is compressed in the longitudinal direction as a result of the movement of the cover 9. Owing to the comparatively rapid movement of the stroke lifter 4 only a small, practically negligible quantity of the hydraulic fluid H passes through a throttle point 24 during the time of the lifter's actuation.

As a result a pressure can be built up in the first sub-chamber 10 which is not transferred into the second sub-chamber 11 and consequently is generated substantially losslessly. The increased pressure is passed on by way of the hydraulic line 17 to the hydraulic fluid H contained in the metal bellows 18, with the result that the primary lifter 20 is extended outward against the pressure of the spring element 21 and the valve 22 is able to switch, for example open.

With the termination of the actuation of the piezoelectric actuator 2, the primary lifter 4 is retracted again by the spring force of the outer metal bellows 6 and the pressure in the hydraulic fluid H decreases once more. As a result the secondary lifter 20 is also moved back by the spring element 21 into the metal bellows 18, thereby causing a switch position of the valve 22 to be reset again, the valve 22 being closed again for example.

For rapid movements, as are typical when a piezoelectric actuator 2 is actuated, the hydraulic temperature compensator 5 therefore serves for building up the pressure in the valve 1.

In the event that the valve 1 heats up (slowly in comparison with an actuation of the piezoelectric actuator 2), the pressure of the hydraulic fluid H will slowly increase on account of thermal expansion. This will increase a pressure difference between the second sub-chamber 11 and the gas-filled chamber 12, such that the gas-filled chamber 12 will be compressed along the longitudinal axis L due to a compression of the second metal bellows 7 and the volume of the second sub-chamber 11 will increase correspondingly. As a result of the increase in volume of the second sub-chamber 11 the hydraulic fluid H relaxes again and can be held at a pressure that is only slightly increased in relation to the original temperature level. The gas-filled chamber 12 therefore serves as a compensation volume for compensating a temperature-induced expansion in volume of the hydraulic fluid H. Thus, a change in volume generated as a result of slow processes, for example a change in temperature, can be effectively limited. Since the throttle point 24 is practically permeable to the hydraulic fluid H in the case of slow processes, the limiting of the increase in pressure of the hydraulic fluid H will also be effective for the other sections of the valve 1 that are filled with the hydraulic fluid H, namely for the first sub-chamber 10 and for the metal bellows 18 for example. As a result a position of the secondary lifter 20, in particular an idle position, can in turn be kept constant practically independently of temperature fluctuations at the valve, thereby improving a switching precision.

Figure 2:
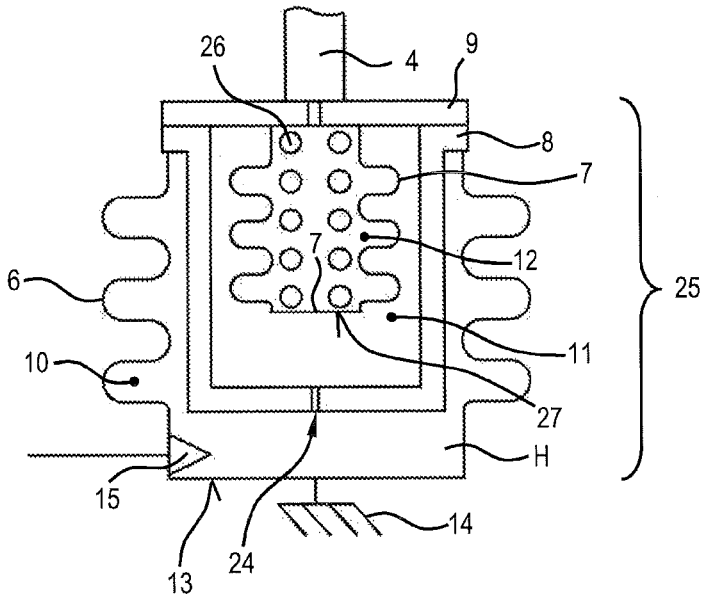
FIG. 2 shows as a sectional representation in a side view a proposed thermal compensator according to a second embodiment variant.

FIG. 2 shows as a sectional representation in a side view a hydraulic temperature compensator 25 according to a second embodiment variant, which can for example be installed in the valve 1 instead of the hydraulic temperature compensator 5. Compared with the hydraulic temperature compensator 5, the hydraulic temperature compensator 25 has an additional compression spring 26 in the gas-filled chamber 12. The compression spring is in this case embodied as a spiral spring which is supported on one side on the cover 9 and on the other side on a base 27 of the inner metal bellows 7. Due to the compression spring 26 the inner metal bellows 7 is extended to a greater extent and is functionally stiffened to counter a deformation in the longitudinal direction. Thus, the compression spring 26 causes the system pressure of the hydraulic fluid to increase. By the compression spring 26 it is furthermore possible to set a ratio very precisely between a change in pressure of the hydraulic fluid H and an associated increase in volume of the second sub-chamber 11, and consequently also to establish a relationship between a pressure level of the hydraulic fluid H and a temperature of the hydraulic fluid H.

Figure 3:
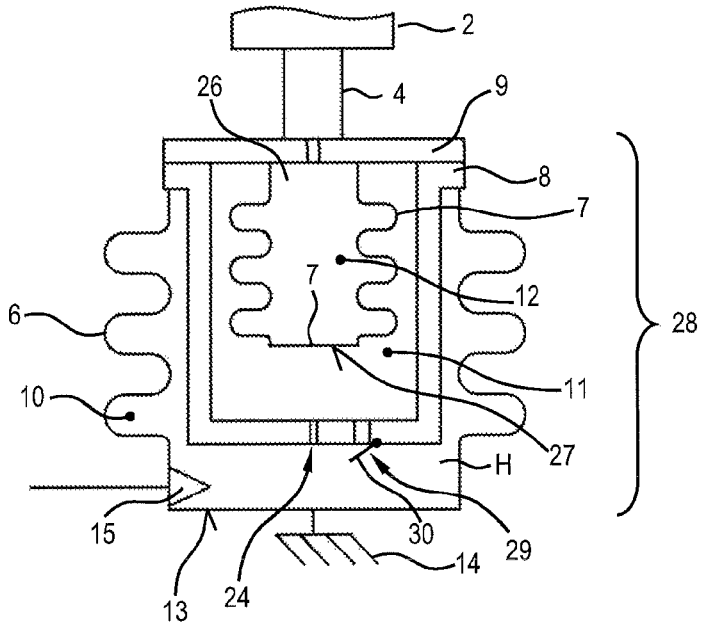
FIG. 3 shows as a sectional representation in a side view a proposed thermal compensator according to a third embodiment variant.

FIG. 3 shows as a sectional representation in a side view a hydraulic temperature compensator 28 which can be installed in the valve 1 for example instead of the hydraulic temperature compensator 5. In contrast to the hydraulic temperature compensator 5, the hydraulic temperature compensator 28 has, at the partition, a flutter valve 29 which has an associated flap 30 at an outside face of the partition 8 adjoining the first sub-chamber 10. The flutter valve 29 effects a reduction in a "dead time" between two actuations of the piezoelectric actuator 2 during normal operation, for each time the piezoelectric actuator 2 presses the cover 9 downward by way of the lifter 4, the pressure in the first sub-chamber 10 increases as described. Although in relation to a single actuation operation this causes only a negligibly small amount of the hydraulic fluid H to be forced from the first sub-chamber 10 into the second sub-chamber 11 through the throttle point 24, when the lifter 4 returns to its idle position it nonetheless results in a pressure difference, albeit only a minor one, between the first sub-chamber 10 and the second sub-chamber 11 in the direction of the first sub-chamber 10. This pressure difference should preferably be reduced before the piezoelectric actuator 2 can be actuated again, since otherwise the hydraulic fluid H will over time be pumped into the second sub-chamber 11. The flutter valve 29 (or, alternatively, any other suitable unidirectional valve having a comparatively large flow cross-section and allowing the hydraulic fluid to flow through from the second sub-chamber 11 into the first sub-chamber 10) speeds up this pressure compensation and enables a more rapid re-actuation of the piezoelectric actuator 2 or the lifter 4.

Thus, in the exemplary embodiments shown, the thermal temperature compensator 5, 25, 28 may be manufactured separately and installed and filled as a unit in the valve 1.

Alternatively the hydraulic temperature compensator may be more closely integrated into the valve 1, in that for example the outer metal bellows 6 and the metal bellows 18 are present as a single metal bellows and therefore the actuating element 20 would be separated from the second metal bellows 7 solely by the hydraulic fluid H. This would also allow the hydraulic line 17 to be omitted, and a valve having a particularly compact design format can be achieved.

Features of the different exemplary embodiments can also be combined, e.g. for a hydraulic temperature compensator having a compression spring in the gas-filled chamber and in addition a unidirectional valve in the partition.

The invention has been described in detail with particular reference to preferred embodiments thereof and examples, but it will be understood that variations and modifications can be effected within the spirit and scope of the invention covered by the claims which may include the phrase "at least one of A, B and C" as an alternative expression that means one or more of A, B and C may be used, contrary to the holding in Superguide v. DIRECTV, 69 USPQ2d 1865 (Fed. Cir. 2004).

The invention claimed is:

1. A hydraulic temperature compensator, comprising:

a gas-filled chamber;

a longitudinally extensible first hydraulic chamber at least partly enclosing the gas filled chamber, the hydraulic chamber comprising a first sub-chamber and a second sub-chamber, the second sub-chamber adjoining the gas-filled chamber, the first hydraulic chamber being formed by:

an outer wall having an open first end;

an inner wall having an open end, the inner wall being contactlessly inserted into the outer wall, the inner wall separating the second sub-chamber from the gas-filled chamber such that the inner wall at least partially defines the gas-filled chamber;

a partition member having an open end and a partitioning section, the partitioning section being contactlessly inserted between the outer wall and the inner wall, the partitioning section separating the first sub-chamber from the second sub-chamber, the partitioning section having a throttle point to connect the first and second sub-chambers to each other;

a hydraulic port coupled to the first sub-chamber for providing a fluid passage to a second hydraulic chamber associated with a movable actuating element;

a common cover at a first side of the first hydraulic chamber and hermetically attached to the open end of the inner wall, the open end of the outer wall, and the open end of the partition member, the cover being longitudinally movable in response to a longitudinal force imposed on the cover by an actuator;

a base coupled to or formed by a second end of the outer wall, the base being rigidly fixed; and wherein a longitudinal movement of the cover causes a compression of the first sub-chamber of the first hydraulic chamber, which forces a fluid flow from the first sub-chamber to the second hydraulic chamber associated with the movable actuating element via the hydraulic port.

2. The hydraulic temperature compensator as claimed in claim 1, wherein the inner wall and the outer wall are each embodied as a bellows having an open end side, and the open end sides of the bellows correspond respectively with the open ends of the inner and outer walls.

3. The hydraulic temperature compensator as claimed in claim 1, wherein the partition member is embodied as a hollow cylinder having an open end side corresponding to the open end of the partition.

4. The hydraulic temperature compensator as claimed in claim 1, wherein the outer wall is hermetically attached to the partition member and the partition member is hermetically attached to the cover.

5. The hydraulic temperature compensator as claimed in claim 1, wherein the outer wall and the partition member are hermetically attached to the cover individually.

6. The hydraulic temperature compensator as claimed in claim 1, wherein a compression spring element is accommodated in the gas-filled chamber.

7. The hydraulic temperature compensator as claimed in claim 1, wherein the first hydraulic chamber has a unidirectional valve, which enables only a flow from the second sub-chamber into the first sub-chamber.

8. The hydraulic temperature compensator as claimed in claim 1, wherein the first hydraulic chamber has a unidirectional valve, and the second sub-chamber is connected to the first sub-chamber by both the throttle point and the unidirectional valve.

9. The hydraulic temperature compensator as claimed in claim 7, wherein the unidirectional valve is a flutter valve.

10. The hydraulic temperature compensator as claimed in claim 1, wherein the first hydraulic chamber is filled with a substantially incompressible fluid.

11. The hydraulic temperature compensator as claimed in claim 1, wherein the first hydraulic chamber is filled with oil filled under vacuum.

12. A stroke transmitter, comprising:

a hydraulic temperature compensator, comprising:

a gas-filled chamber;

a longitudinally extensible first hydraulic chamber at least partly enclosing the gas filled chamber, the first hydraulic chamber comprising a first sub-chamber and a second sub-chamber, the second sub-chamber adjoining the gas-filled chamber, the first hydraulic chamber being formed by:

an outer wall having an open end;

an inner wall having an open end, the inner wall being contactlessly inserted into the outer wall, the inner wall separating the second sub-chamber from the gas-filled chamber such that the inner wall at least partially defines the gas-filled chamber; and a partition member having an open end and a partitioning section, the partitioning section being contactlessly inserted between the outer wall and the inner wall, the partitioning section separating the first sub-chamber from the second sub-chamber, the partitioning section having a throttle point to connect the first and second sub-chambers to each other; and a common cover hermetically attached to the open end of the inner wall, the open end of the outer wall and the open end of the partition member:

a stroke actuator configured to impose a longitudinal force on the cover of the temperature compensator to cause a longitudinal movement of the cover; and a second hydraulic chamber fluidically connected to the first sub-chamber of the first hydraulic chamber of the temperature compensator, the second hydraulic chamber being in fluidic connection with a displaceably mounted actuating element;

wherein a longitudinal movement of the cover imparted by the stroke actuator causes a compression of the first sub-chamber of the first hydraulic chamber, which forces a fluid flow from the first sub-chamber to the second hydraulic chamber via the hydraulic port.

13. The stroke transmitter as claimed in claim 12, wherein the stroke actuator and the temperature compensator are mounted between two thrust bearings.

14. The stroke transmitter as claimed in claim 12, wherein the stroke transmitter is an injector stroke transmitter.

* * * * *